United States Patent [19]

LeStrange

[11] Patent Number: 4,965,184

[45] Date of Patent: Oct. 23, 1990

[54] SILVER HALIDE EMULSIONS WITH IMPROVED SPEED

[75] Inventor: Raymond J. LeStrange, Hendersonville, N.C.

[73] Assignee: E. I. Du Pont de Nemours and Company, Wilmington, Del.

[21] Appl. No.: 314,199

[22] Filed: Feb. 23, 1989

[51] Int. Cl.[5] ..... G03C 1/08

[52] U.S. Cl. ..... 430/603; 430/599; 430/608

[58] Field of Search ..... 430/599, 608, 603

[56] References Cited

U.S. PATENT DOCUMENTS

| | | | |
|---|---|---|---|
| 2,099,404 | 11/1937 | Kogel et al. | 430/264 |
| 2,527,268 | 10/1950 | Hart et al. | 95/7 |
| 3,193,386 | 7/1965 | White | 430/607 |
| 3,874,947 | 4/1975 | Hayakawa et al. | 430/374 |

FOREIGN PATENT DOCUMENTS

| | | |
|---|---|---|
| 1171266 | 5/1964 | Fed. Rep. of Germany . |
| 53021922 | 8/1976 | Japan . |
| 58-221839 | 6/1982 | Japan . |
| 59075249 | 10/1982 | Japan . |
| 50006940 | 6/1983 | Japan . |
| 42300x | 3/1966 | U.S.S.R. . |

*Primary Examiner*—Paul R. Michl
*Assistant Examiner*—Janet C. Baxter

[57] ABSTRACT

Photographic, silver halide emulsions can be additionally sensitized without a deleterious increase in fog, by the addition of an alkali metal salt of 1-napthol-4-sulfonic acid. These emulsions are stable, and have good contrast and top density. The 1-napthol-4-sulfonic acid can be added conveniently from an aqueous solution and is totally compatible with conventional silver halide elements.

7 Claims, No Drawings

SILVER HALIDE EMULSIONS WITH IMPROVED SPEED

BACKGROUND OF THE INVENTION

1. Field of the Invention:

This invention relates to silver halide emulsions used to prepare photographic elements having improved speed. This invention especially relates to fine grain emulsions having low fog and good contrast.

2. Description of the Prior Art:

There are a host of silver halide emulsion sensitizers known in the prior art. These include, for example, both inorganic and organic sulfur compounds. Many of these compounds increase emulsion speed but also have a deleterious affect on fog. This is especially true with finer grain emulsions designed to increase covering power and contrast, for example. Thus, there is a pressing need to find chemical sensitizers for fine grain photographic emulsions, for example, that increase emulsion or film speed without reducing covering power or gradient, or increasing fog. The use of certain organic sulfur containing compounds such as the napthol sulfonates are known in the prior art. Most of these prior art references require that the alkali metal or ammonium salt of napthol sulfonates be prepared therefor and then that these compounds be added to the requisite emulsion in an organic solvent. Of course, the use of organic solvents in aqueous silver halide systems is highly undesirable in most instances. Additionally, there is no teaching in the prior art of the addition of specific napthol sulfonates in an aqueous medium to a photographic emulsion to increase the speed thereof.

SUMMARY OF THE INVENTION

It is an object of this invention to provide a method for the further chemical sensitization of gelatino silver halide emulsions. It is a further object of this invention to provide such chemical sensitization without deleterious side effects such as an increase in emulsion fog. These and yet other objects are achieved by a process for the sensitization of a photosensitive element comprising a support containing at least one photosensitive emulsion coated thereon wherein said emulsion contains a sensitizing, amount of the alkali metal salt of 1-naphthol-4-sulfonic acid therein. In yet an alternative embodiment, the sensitizer of this invention can be added in combination with other, conventional sensitizers.

DETAILS OF THE INVENTION

It is unusual that the 1-napthol-4-sulfonic acid can be used to sensitize as photographic specifically emulsion. Although the prior art does indeed teach that compounds of a genus which includes this specific compound can be added to photographic emulsions, this reference requires that these compounds be added as the alkali metal salt in an organic solvent. In addition, this reference does not teach the specificity of the 1-naphthol-4-sulfonic acid compound and the unusual results such as the increase in speed that can be achieved by its addition to a photographic emulsion. I have found that after simply preparing an aqueous solution of the alkali metal salt of 1-naphthol-4-sulfonic acid, this material can be used to increase the sensitivity of a photographic emulsion. I prefer adding an amount of the aforesaid solution to an emulsion that has already been brought to a high degree of sensitivity with gold and sulfur salts as is well known to those of normal skill in the art. In this case, the aqueous solution of the alkali metal salt of 1-naphthol-4-sulfonic acid is added after the normal sensitization is complete. An even higher degree of sensitivity is then achieved. I prefer making up the aqueous solution of the salt of this invention at ca. 1–20% by weight, with 8–12% being preferred, and to add an amount equivalent to 1–20 grams of the salt, on a dry basis, per 1.5 mole of silver halide present in the emulsion, with 2–8 grams being preferred.

I can use this sensitizer with any of the conventional silver halide emulsions including bromide, chloride and iodide and mixtures thereof. I prefer silver bromoiodide emulsions in which the iodide is ca. 5% or less. The emulsions of this invention conventionally contain gelatin as the primary binder. However, in place of gelatin, other natural or synthetic water-permeable organic colloid binding agents can be used as a total or partial replacement thereof. Such agents include water permeable or water-soluble polyvinyl alcohol and its derivatives, e.g., partially hydrolyzed polyvinyl acetates, polyvinyl ethers, and acetals containing a large number of extralinear —$CH_2CHOH$— groups; hydrolyzed interpolymers of vinyl acetate and unsaturated addition polymerizable compounds such as maleic anhydride, acrylic and methacrylic acid ethyl esters, and styrene. Suitable colloids of the last mentioned typed are disclosed in U.S. Pat. Nos. 2,276,322, 2,276,323 and 2,347,811. The useful polyvinyl acetals include polyvinyl acetalaldehyde acetal, polyvinyl butyraldehyde acetal and polyvinyl sodium o-sulfobenzaldehyde acetal. Other useful colloid binding agents include the poly-N-vinyllactams of Bolton U.S. Pat. No. 2,495,918, the hydrophylic copolymers of N-acrylamido alkyl betaines described in Shacklett U.S. Pat. No. 2,833,650 and hydrophilic cellulose ethers and esters. Phthalated gelatins may also be used as well as binder adjuvants useful for increasing covering power such as dextran or the modified, hydrolysed gelatins of Rakoczy, U.S. Pat. No. 3,778,278.

These emulsions can be additionally sensitized with any of the conventional and well-known sulfur sensitizers. Sulfur sensitizers include those which contain labile sulfur, e.g. allyl isothiocyanate, allyl diethyl thiourea, phenyl isothiocyanate and sodium thiosulfate for example. The polyoxyalkylene ethers in Blake et al., U.S. Pat. No. 2,400,532, and the polyglycols disclosed in Blake et al., U.S. Pat. No. 2,423,549. Other non-optical sensitizers such as amines as taught by Staud et al., U.S. Pat. No. 1,925,508 and Chambers et al., U.S. Pat. No. 3,026,203, and metal salts as taught by Baldsiefen, U.S. Pat. No. 2,540,086 may also be used.

The emulsions can contain known antifoggants, e.g. 6-nitrobenzimidazole, benzotriazole, triazaindenes, etc., as well as the usual hardeners, i.e., chrome alum, formaldehyde, dimethylol urea, mucochloric acid, etc. Other emulsion adjuvants that may be added comprise matting agents, plasticizers, toners, optical brightening agents, surfactants, image color modifiers, non-halation dyes, and covering power adjuvants among others.

The film support for the emulsion layers used in the novel process may be any suitable transparent plastic. For example, the cellulosic supports, e.g. cellulose acetate, cellulose triacetate, cellulose mixed esters, etc. may be used. Polymerized vinyl compounds, e.g., copolymerized vinyl acetate and vinyl chloride, polystyrene, and polymerized acrylates may also be mentioned. Preferred films include those formed from the polyesterification product of a dicarboxylic acid and a dihydric alcohol made according to the teachings of Alles, U.S. Pat. No. 2,779,684 and the patents referred to in the specification thereof. Other suitable supports are the polyethylene terephthalate/isophthalates of British patent No. 766,290 and Canadian patent No. 562,672 and those obtainable by condensing terephthalic acid and dimethyl terephthalate with propylene glycol, diethylene glycol, tetramethylene glycol or cyclohexane 1,4-dimethanol (hexahydro-p-xylene alcohol). The films of Bauer et al., U.S. Pat. No. 3,052,543 may also be used. The above polyester films are particularly suitable because of their dimensional stability.

Tabular grain silver halide products are well-known in the prior art and present the user with some considerable advantages over conventional grain products (e.g. semi-spheroidal grains, for example. The tabular products can usually be coated at a much thinner coating weight without loss of covering power. They are also more easily developed and can be hardened with lower amounts of conventional hardeners presenting quite an advantage over the conventional grains. Tabular chloride emulsions are also well-known and are described by Maskasky in U.S. Pat. No. 4,400,463, 8/23/83 and also by Wey, U.S. Pat. No. 4,399,205. Some other references which describe the manufacture and use of tabular grain elements are Dickerson, U.S. Pat. No. 4,414,304; Wilgus et al., U.S. Pat. No. 4,434,226; Kofron et al., U.S. Pat. No. 4,439,520; and, Nottorf, U.S. Pat. No. 4,772,886.

The photosensitive and/or radiation sensitive layers useful with the present invention may be any which are well-known for imaging and reproduction in fields such as graphic arts, printing, medical, and information systems. Photographic silver halide emulsion employing any of the commonly known halides (e.g. bromide, chloride, iodide or mixtures of two or more) may be used. These may be of varied content and be negative and/or positive working. The response of the silver halide may be enhanced and stabilized by such chemical agents as boranes, amines, polyethylene oxides, tetraazaindenes, benzotriazole, alkali halides, phenyl mercaptotetrazole, and gold, mercury and sulfur compounds. In addition dyes, development modifiers, covering power polymers, surfactants, latices, hardeners and other addenda known in the photographic art may be employed with the photographic silver halide emulsion.

This invention will now be illustrated by the following examples out of which I consider Example 1 to present the best mode of this invention. All percentages and parts are by weight unless otherwise indicated.

EXAMPLE 1

A standard, high speed medical X-ray-type emulsion was prepared. This emulsion was ca. 98.0% bromide and ca. 2.0% iodide (0.22 $\mu^3$ median grain volume) and contained 0.6/1 gel/silver after redispersion. The emulsion was brought to its optimum sensitivity by the addition of a sulfur sensitizer (Thionex® tetramethyl monosulfide) and a gold sensitizer ($AuCl_3$). Antifoggants ($HgCl^2$; phenylmercaptotetrazole; 5-methyl-7-hydroxy-1,3,5-triazaindolizine; and the dipotassium salt of hydroquinone disulfonic acid) were also added. Wetting agents and coating aids (saponin and Triton®-100, a non-ionic polyalkylene oxide) were added along with some modified hydrolyzed gelatin prepared according to the teachings of Rakoczy, U.S. Pat. No. 3,778,278. The emulsion was hardened with formaldehyde. The emulsion was split into five (5) portions and varying amounts of a 10% aqueous solution of the sodium salt of 1-naphthol-4-sulfonic acid (Aldrich Chem. Co., Milwaukee, WI) were added to each portion as shown below. Each portion was then coated on conventional 7 mil polyethylene terephthalate film support to which a small amount of blue dye had been added to impart tint. The film support was coated on both sides with a conventional resin sub along with a thin gelatin substratum coated supra to said resin sub. Each emulsion was coated to a thickness of ca. 80 mg of $AgBr/dm^2$ and a hardened gelatin abrasion layer coated over said emulsion layer. Samples of each coating were then given a standard tungsten exposure through a $\sqrt{2}$ wedge. Two strips were used in a back-to-back relationship to simulate standard, double-side coated medical X-ray film. The strips were then developed, fixed washed and dried in an automatic processing mode to simulate 90 second medical X-ray processing conditions. Each of the strips was examined sensitometrically and the following results were obtained:

| Amt. of 1-naphthol-4-sulfonic acid sodium salt added | Sensitometry | | |
|---|---|---|---|
| (g./1.5 moles AgX | Rel Spd | Gradient | Fog |
| None - Control | 100 | 3.20 | .15 |
| 1 | 106 | 3.22 | .15 |
| 2 | 107 | 3.44 | .15 |
| 4 | 108 | 3.68 | .14 |
| 8 | 112 | 4.11 | .15 |

Thus, speed increases up to 12% were seen in this experiment. Additionally, it was noted that there was no increase in fog and that the gradient was improved. Samples of these films were also tested after 1 week of tropical oven (49° C., 65% R. H.) aging. All films were stable as regards sensitometry which indicated that the addition of the 1-naphthol-4-sulfonic acid did not affect film stability.

EXAMPLE 2

Another medical X-ray type emulsion was prepared. This emulsion is similar to that described in Example 1 except that the average grain size was 0.24 $\mu^3$ median grain volume and the emulsion contained ca. 97.7% Br and ca 2.3% I and a 0.7/1 gel silver ratio. This emulsion was designed to produce a wide latitude on exposure and is primarily used for chest radiography work where high speed, lower gradient is desired. This emulsion was then split into three (3) large portions and each of these portions was sensitized to a different level using conventional sulfur compounds. Thionex was used in combination with gold thiocyanate. Each of these portions was further split into four (4) sub portions to which varying amounts of 1-naphthol-4-sulfonic acid (1-N-4S-sodium salt, 10% aqueous solution) was then added as shown below. Each sample was coated, overcoated, dried, exposed, developed, fixed, washed and dried as described in Example 1 and the sensitometry obtained is shown below:

| Amt. of 1-N-4S | Amt. of Conv. | Sensitometry | |
|---|---|---|---|
| added (g/1.5 M AgX) | Sens. Added | Rel Speed | Fog |
| None - Control 1 | 16 | 100 | .43 |
| 2 | " | 100 | .40 |

-continued

| Amt. of 1-N-4S added (g/1.5 M AgX) | Amt. of Conv. Sens. Added | Sensitometry Rel Speed | Fog |
|---|---|---|---|
| 4 | " | 110 | .42 |
| 8 | " | 121 | .43 |
| None - Control 2 | 18 | 100 | .50 |
| 2 | " | 110 | .48 |
| 4 | " | 116 | .49 |
| 8 | " | 135 | .49 |
| None - Control 3 | 20 | 100 | .58 |
| 2 | " | 116 | .61 |
| 4 | " | 135 | .61 |
| 8 | " | 139 | .58 |

These results show that even at a relatively high level of conventional sensitization, one which tends to increase the fog level, the compound of this invention can be added to further increase the speed without a subsequent increase in fog. This is an important advance since films made with a higher level of conventional sensitizers have a more stable shelf life.

EXAMPLE 3

In order to compare 1-naphthol-4-sulfonic acid with an analog thereof (1-naphthol-2-sulfonic acid 1-N-2S) a sample of the emulsion from Example 1 was prepared and sensitized as described therein. Ten (10) portions of this emulsion were taken and various amounts of the sodium salt of 1-N-4S or 1-N-2S (10% aqueous solution) added thereto as described below. Each portion was then coated, overcoated, dried, exposed, developed, fixed, washed as described in Example 1 and the sensitometry obtained is also shown below:

| Amt. of 1-N-4S (g/1.5 mol AgX) | Amt. of 1-N-2S (g/1.5 mol AgX) | Sensitometry Rel. Spd. | Grad. | B + Fog |
|---|---|---|---|---|
| Control - None | Control - None | 100 | 3.03 | .16 |
| 1 | 0 | 106 | 3.04 | .16 |
| 2 | 0 | 110 | 3.04 | .15 |
| 4 | 0 | 110 | 3.39 | .15 |
| 8 | 0 | 114 | 3.65 | .15 |
| 0 | 1 | 106 | 3.03 | .15 |
| 0 | 2 | 96 | 3.05 | .15 |
| 0 | 4 | 98 | 2.95 | .15 |
| 0 | 8 | 96 | 3.06 | .15 |

Samples from each of the above coatings were given placed in a tropical oven (see Example 1) for one (1) week and retested sensitometrically. The results were equivalent and indicated stability of the product. However, as can be seen from the above data, only those samples containing 1-N-4S showed a substantial increase in speed at good fog.

EXAMPLE 4

In order to test yet other analogs of 1-N-4S, samples of 1-naphthol-5-sulfonic acid, 2-naphthol-7-sulfonic acid and 2-napthol-8-sulfonic acid were obtained from the same source (see Example 1). Each of these elements was made up as a 10% aqueous solution (sodium salt) and added to portions of emulsions prepared as described in Example 1. Each portion was then coated, exposed and processed as described therein with the following results:

| Cmpd. Added | Amt. Added (g/1.5 mol. AgX) | Sensitometry Rel. Spd. | Grad. | B + Fog |
|---|---|---|---|---|
| None - Control | | 100 | 4.02 | 16 |
| 1-N-4S | 2 | 110 | 4.26 | 15 |
| 1-N-5S | 2 | 96 | 4.44 | 15 |
| 2-N-7S | 2 | 104 | 4.30 | 15 |
| 2-N-8S | 2 | 102 | 4.39 | 16 |

These data indicate that only 1-N-4S gives a significant speed advantage within the ability of the sensitometry to measure same.

I claim:

1. In a process for formation of a sensitized photosensitive element with at least one photosensitive silver halide emulsion containing a sensitizer wherein the improvement comprises introducing into said emulsion in addition to the sensitizer a sensitizing amount of an alkali metal salt of 1-naphthol-4-sulphonic acid in a concentration of from 1 to 20 grams per 1.5 mole of silver halide whereby the emulsion has increased sensitivity resulting in an increase in speed.

2. The process of claim 1 wherein the metal salt is added at a time following introduction of the sensitizer into the silver halide emulsion.

3. The process of claim 2 wherein the sensitizer is tetramethyl thiuram monosulfide and $AuCl_3$.

4. The process of claim 3 wherein the metal salt is added as an aqueous solution of a sodium salt.

5. The process of claim 4 wherein said sodium salt is present in solution at a concentration from 1 to 20% by weight.

6. The process of claim 5 wherein said concentration is from 8 to 12% by weight.

7. A sensitized photosensitive element produced by the process of claim 1.

* * * * *